US012221248B2

(12) United States Patent
Zhang

(10) Patent No.: US 12,221,248 B2
(45) Date of Patent: Feb. 11, 2025

(54) COMPOSITE PALLET WITH AUGMENTED COMPRESSION SUPPORT, AND PROCESS FOR MANUFACTURING SAME

(71) Applicant: Paul Zhang, West Palm Beach, FL (US)

(72) Inventor: Paul Zhang, West Palm Beach, FL (US)

( * ) Notice: Subject to any disclaimer, the term of this patent is extended or adjusted under 35 U.S.C. 154(b) by 0 days.

(21) Appl. No.: 18/713,709

(22) PCT Filed: Nov. 27, 2023

(86) PCT No.: PCT/US2023/081224
§ 371 (c)(1),
(2) Date: Jul. 15, 2024

(87) PCT Pub. No.: WO2024/258442
PCT Pub. Date: Dec. 19, 2024

(65) Prior Publication Data

US 2024/0417134 A1 Dec. 19, 2024

Related U.S. Application Data

(60) Provisional application No. 63/521,472, filed on Jun. 16, 2023.

(51) Int. Cl.
*B65D 19/00* (2006.01)

(52) U.S. Cl.
CPC ..... *B65D 19/0002* (2013.01); *B65D 2519/00019* (2013.01); *B65D 2519/00054* (2013.01);
(Continued)

(58) Field of Classification Search
CPC ..... B65D 2519/00019; B65D 2519/00054; B65D 2519/00029; B65D 2519/00064;
(Continued)

(56) References Cited

U.S. PATENT DOCUMENTS 3,470,832 A * 10/1969 Heffernan ..... B65D 19/0028 108/55.5
3,601,067 A * 8/1971 Olsen ..... B65D 19/0028 108/51.3
(Continued)

FOREIGN PATENT DOCUMENTS

DE 2007055 A1 9/1971
EP 0878405 A1 11/1998

*Primary Examiner* — Jose V Chen
(74) *Attorney, Agent, or Firm* — Lance M. Pritikin

(57) ABSTRACT

Exemplary embodiments of a composite pallet with augmented compression support may comprise a pallet pulp body, a multiplicity of support foot sheathes, and a support bottom plate. The pallet pulp body may be comprised of pulp and may have an upper faceplate and a plurality of support feet disposed oppositely of the upper faceplate. A foot cavity may be defined within each support foot. Each of the support foot sheaths may envelope at least a portion of a corresponding support foot. The support bottom plate may be affixed to two or more of the support foot sheaths. A plurality of arcuate stiffener grooves may be disposed in the upper faceplate. One or more of the foot cavities may have a compression column disposed therein. Each compression column may comprise one or more column layers, a compression column block, or a combination thereof. The column layers may be nested.

7 Claims, 10 Drawing Sheets

(52) U.S. Cl.
CPC ..... *B65D 2519/00059* (2013.01); *B65D 2519/00064* (2013.01); *B65D 2519/00069* (2013.01); *B65D 2519/00079* (2013.01); *B65D 2519/00323* (2013.01); *B65D 2519/00338* (2013.01)

(58) Field of Classification Search
CPC ..... B65D 2519/00089; B65D 2519/00099; B65D 2519/00338
USPC ..... 108/51.11, 51.3, 57.22, 57.31
See application file for complete search history.

(56) References Cited

U.S. PATENT DOCUMENTS 3,757,704 A 9/1973 Allgeyer et al.
4,244,766 A * 1/1981 Yellen ..... B29C 66/112 156/291
4,487,136 A * 12/1984 Beckway ..... B65D 19/0028 108/51.3
4,671,188 A * 6/1987 Betro ..... B65D 19/40 108/156
4,717,025 A * 1/1988 Maurer ..... B65D 19/20 108/55.3
4,850,284 A * 7/1989 DeGroot ..... B65D 19/0012 108/56.3
5,121,696 A * 6/1992 Harder ..... B65D 19/0026 248/633
5,195,440 A * 3/1993 Gottlieb ..... B65D 19/0026 108/56.3
5,452,667 A * 9/1995 Lim ..... B65D 19/0012 108/51.3
5,503,085 A * 4/1996 Rozek ..... B65D 19/0087 108/51.3
5,520,120 A * 5/1996 Badger ..... B65D 19/0028 108/56.3
5,592,885 A * 1/1997 Young, Jr. ..... B65D 19/20 108/56.1
5,603,266 A * 2/1997 Nash ..... B65D 19/0012 108/56.3
5,624,030 A * 4/1997 Rademacher ..... B65D 19/44 206/386
5,649,492 A * 7/1997 Chin-Shu ..... B65D 19/20 108/56.3
5,934,202 A 8/1999 Lai
5,964,162 A 10/1999 Chuan-Jen
6,095,061 A * 8/2000 Perazzo ..... B65D 19/0026 108/51.3
7,597,053 B2 * 10/2009 Muyskens ..... B65D 19/0002 108/51.11
8,671,849 B2 * 3/2014 Krieg ..... D06F 39/001 108/51.11
2002/0189507 A1 * 12/2002 Benner ..... B65D 19/0028 108/56.3
2003/0000432 A1 * 1/2003 Crevillen Pastor ..... B65D 19/0028 108/51.3
2004/0137196 A1 7/2004 Wang
2007/0277706 A1 * 12/2007 Carter ..... B65D 19/0028 108/57.15
2008/0060561 A1 * 3/2008 Carrasco ..... B65D 19/0061 108/51.11
2008/0156234 A1 * 7/2008 van de Camp .... B65D 19/0095 108/51.11
2009/0223420 A1 * 9/2009 Ferguson ..... B65D 19/0073 29/700
2009/0223422 A1 * 9/2009 Monteith ..... B65D 19/0012 493/297
2010/0107933 A1 * 5/2010 Love ..... B31D 3/002 108/51.11
2017/0081075 A1 3/2017 Bruce et al.
2023/0286696 A1 * 9/2023 Moore ..... B65D 19/0004

* cited by examiner

COMPOSITE PALLET WITH AUGMENTED COMPRESSION SUPPORT, AND PROCESS FOR MANUFACTURING SAME

RELATED APPLICATIONS

This application is a U.S. national stage of PCT International Patent Application No. PCT/US2023/081224 having an international filing date of Nov. 27, 2023, which claims the benefit of U.S. Provisional Patent Application No. 63/521,472 filed Jun. 16, 2023. The contents of the above-identified applications are incorporated by this reference in their entireties for all purposes as if fully set forth herein.

TECHNICAL FIELD

The present disclosure relates to pulp molded products, and the systems and processes by which they are manufactured.

BACKGROUND

Load-bearing plates, often referred to as pallets, are very important tools for modern industrial and commercial production, transportation, storage and packaging. With the development of the logistics industry, more and more load-bearing plates are used for storing goods and moving goods. Take the common pallet as an example, which are most typically made of a single, homogeneous material such as wood, steel, plastic or pulp.

Conventional pulp pallet processing technology typically involves the transfer about 2% pulp to the drying part of the manufacturing equipment for drying after molding and vacuum dewatering. Due to the limitations of most conventional pulp materials, the water resistance, compressive strength of the product is low, and durable strength is limited.

SUMMARY

Certain deficiencies of the prior art are overcome by the provision of a composite pallet with augmented compression support, and process for manufacturing same, as disclosed herein.

For example, a pallet pulp body may have support (base) feet first covered with a plastic pressure sheath (otherwise referred to herein as a support foot sheath). The plastic pressure sheath may be pre-formed, for example, in an injection molding machine, and may be composed of material such as, for example, recycled PE plastic. Moreover, a prefabricated film (referred to herein as an upper film layer) may be attached to the upper surface of the pallet pulp body, and may also be comprised of, for example, recycled PE. Once in alignment with one another, these three layers (pallet pulp body, support foot sheaths, and upper film layer) may then be pressed and formed on a hot-pressing machine.

In certain preferred implementations of the invention, support compression columns may be provided for insertion into the foot cavity of each of the support feet. According to the desired compressive strength grade of the composite pallet, the supporting foot compressive columns may comprise different forms of layering. For example, one or more column layers may be successively added to one or more foot cavities of the pallet. There may be, for example, three forms of support foot compression column: semi-closed foot multi-layer compression column, sleeve-type foot multi-layer compression column, and single-block type foot compression column.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
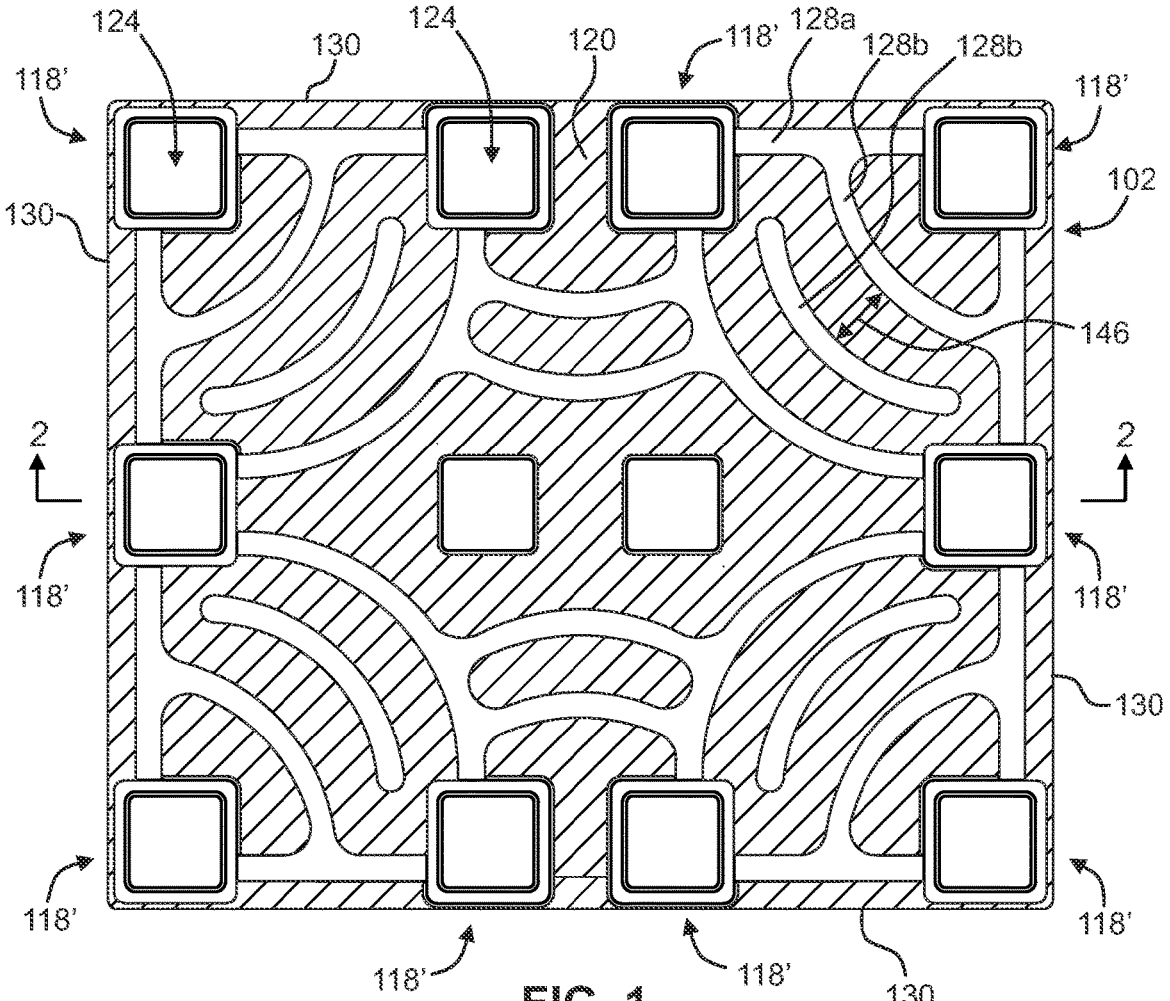
FIG. 1 is a diagrammatic top view of one non-limiting example of a pallet pulp body.

Referring now to the drawings, like reference numerals designate identical or corresponding features throughout the several views.

Figure 8:
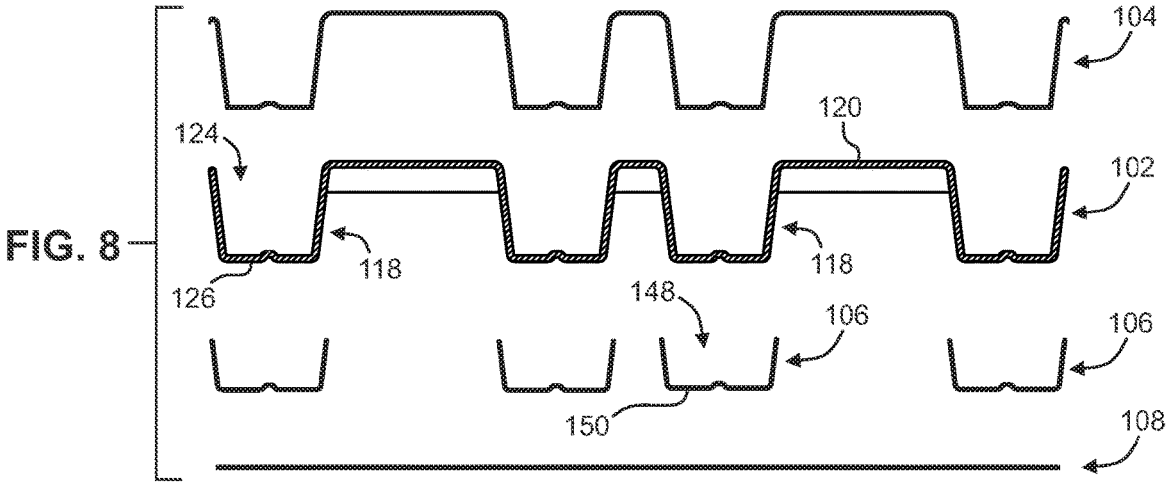
FIG. 8 is a diagrammatic exploded cross-sectional view of the example composite pallet of FIG. 11, taken along lines 2-2 of FIG. 1, illustrating the relevant components prior to being combined in a hot-press mold system.
Figure 11:
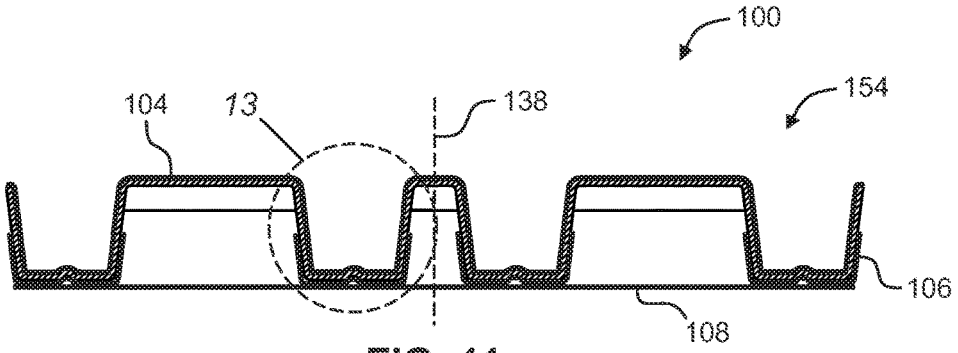
FIG. 11 is a diagrammatic cross-sectional view of an example composite pallet without compression columns.
Figure 12:
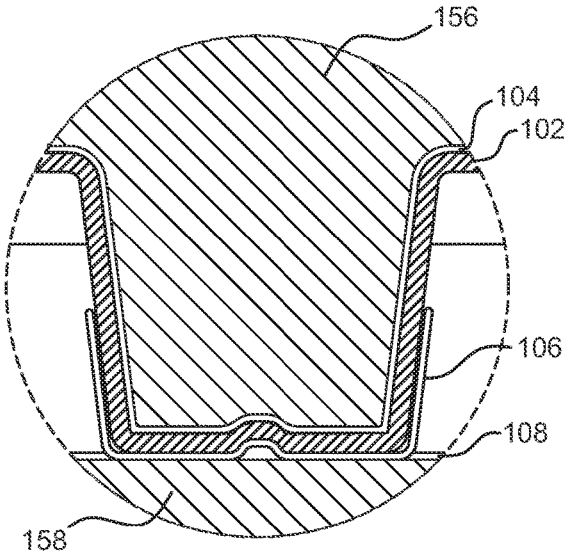
FIG. 12 is a magnified view of detail 12 in FIG. 10.
Figure 13:
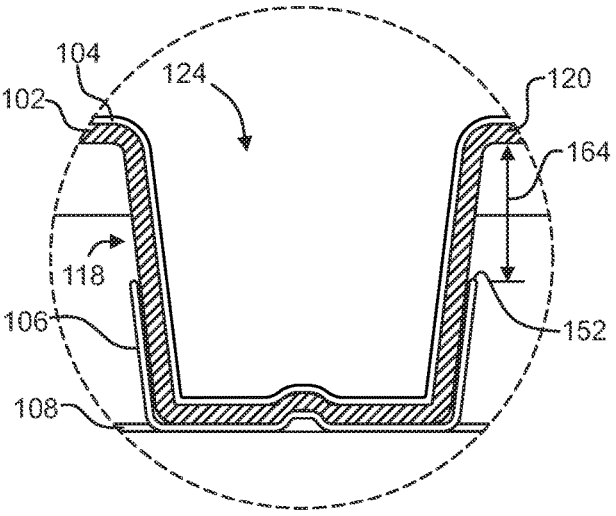
FIG. 13 is a magnified view of detail 13 in FIG. 11.
Figure 16:
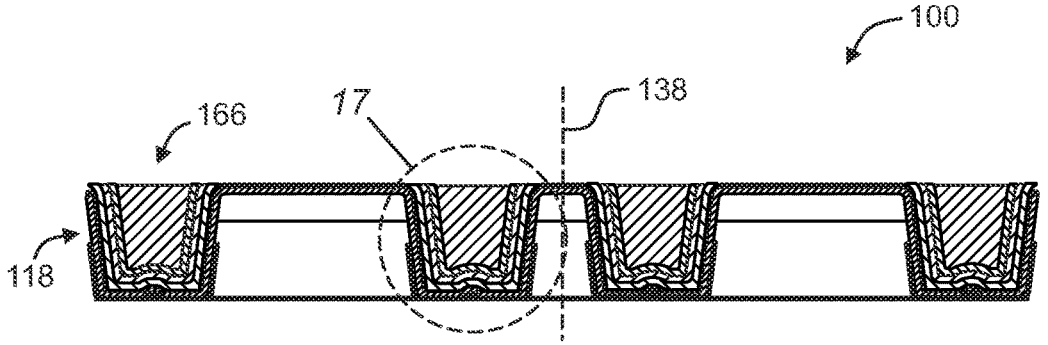
FIG. 16 is a diagrammatic cross-sectional view of an example composite pallet resulting from the assembly step illustrated in FIG. 15.
Figure 20:
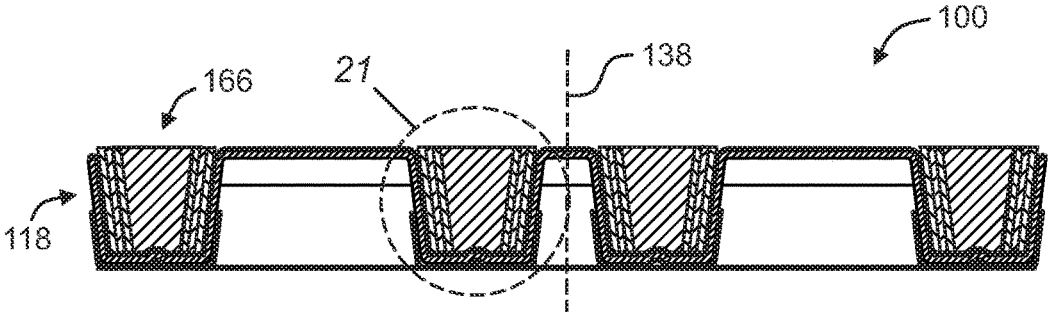
FIG. 20 is a diagrammatic cross-sectional view of an example composite pallet resulting from the assembly step illustrated in FIG. 19.

Certain example embodiments of a composite pallet with augmented compression support are shown generally at 100, for example in FIGS. 11, 16 and 20. Referring to FIGS. 8, 11 and 13, preferred embodiments of the composite pallet 100 may comprise a pallet pulp body 102, an upper film layer 104, a multiplicity of support foot sheaths 106, and a support bottom plate 108.

Figure 2:
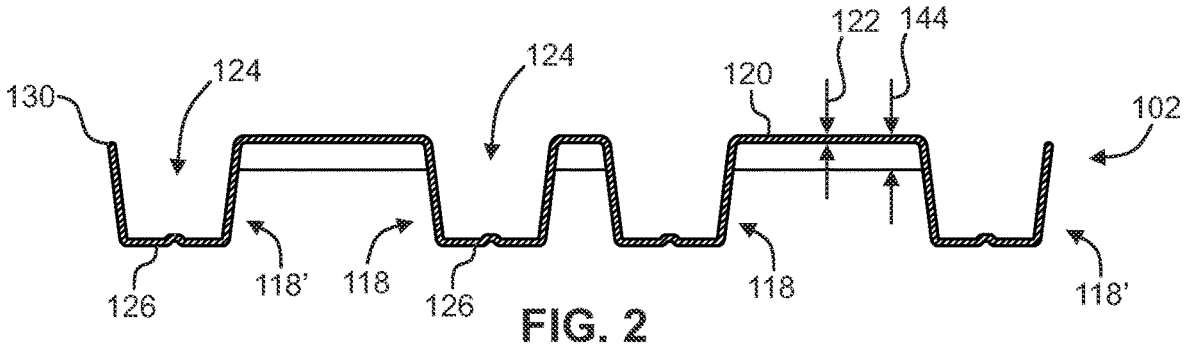
FIG. 2 is a diagrammatic cross-sectional view taken along lines 2-2 in FIG. 1.

Referring to FIGS. 1 and 2, the pallet pulp body 102 may be comprised of pulp and may have an upper faceplate 120 and a plurality of support feet 118 disposed oppositely of the upper faceplate 120. A foot cavity 124 may be defined within each support foot 118, and a foot bottom 126 may be defined oppositely of the foot cavity 124. The pallet pulp body 102 may preferably be comprised of pulp, and may have a wall thickness 122 of, for example, 9-15 millimeters (see, e.g., FIG. 2).

Figure 5:
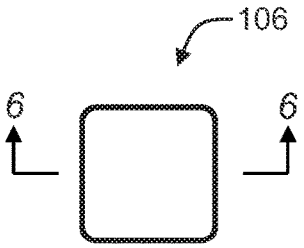
FIG. 5 is a diagrammatic top view of one non-limiting example of a support foot sheath.
Figure 6:
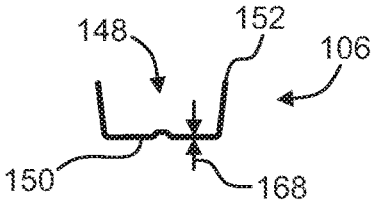
FIG. 6 is a diagrammatic cross-sectional view taken along lines 6-6 of FIG. 5.

Referring to FIGS. 5, 6, 8 and 13, the multiplicity of support foot sheaths 106 may envelop at least a portion of a corresponding one of the support feet 118. Referring to FIG. 6, in certain preferred implementations of the composite pallet 100, each of the support foot sheaths 106 may have a sheath bottom 150 disposed oppositely of a sheath cavity 148. Referring to FIG. 13, in such implementations, the envelopment of the support foot 118 by the support foot sheath 106 may be by way of the sheath cavity 148 receiving the corresponding support foot 118. Indeed, in certain cases there may be an offset distance 164 between the upper faceplate 120 and the sheath periphery 152. The support foot sheaths 106 may preferably have a wall thickness 168 of, for example, 1-5 millimeters.

Referring to FIGS. 8, 11 and 13, a support bottom plate 108 may be affixed to two or more of the support foot sheaths 106. In particular, in certain implementations of the composite pallet 100, the support bottom plate 108 may be affixed to the sheath bottoms 150 of the respective support foot sheaths 106. Referring to FIG. 7B, In particular implementations of the composite pallet 100, the support bottom plate 108 may have a bottom plate aperture 142, and may only be affixed to support foot sheaths 106 that are disposed peripherally about the pallet pulp body 102 (e.g., most proximate to pulp body periphery 130). Such peripherally-disposed support foot sheaths 106 may be defined as those that envelop peripherally-disposed support feet, such as those support feet labeled as 118' in FIGS. 1 and 2. Alternatively, referring to FIGS. 7A and 11, in certain preferred implementations of the composite pallet 100, the support bottom plate 108 may be flat planar without any large apertures, and resultingly may be affixed to all of the support foot sheaths 106, whether peripherally-disposed or not.

Referring to FIG. 1, in particular preferred implementations of the composite pallet 100 the pallet pulp body 102 may include 9 or 12 of the support feet. Additionally or in the alternative, the pallet pulp body 102 may include straight stiffener channels **128*a* disposed between one or more adjacent pairs of support feet 118 (for example between pairs of peripherally-disposed support feet 118'). Moreover, a plurality of arcuate stiffener grooves 128*b* may be disposed in the upper faceplate 120, and two or more of these arcuate stiffener grooves may be arranged concentrically with one another (as shown, for example, in FIG. 1). The straight stiffener channels 128*a* and the arcuate stiffener channels 128*b* may preferably have a channel depth 144 of 20-50 millimeters. Furthermore, at least one adjacent pair of arcuate stiffener channels 128*b* may have a channel spacing 146** of, for example, 80-120 millimeters. Most preferably, the channel spacing may be about 100 millimeters.

Referring to FIGS. 11 and 13, in implementations of the composite pallet 100 which comprise an upper film layer 104, such upper film layer may be disposed on the pallet pulp body 102, and may extend along the upper faceplate 120 and within the foot cavities 124. The upper film layer 104 is preferably waterproof, and may be made of recycled PE plastic or the like.

Figure 17:
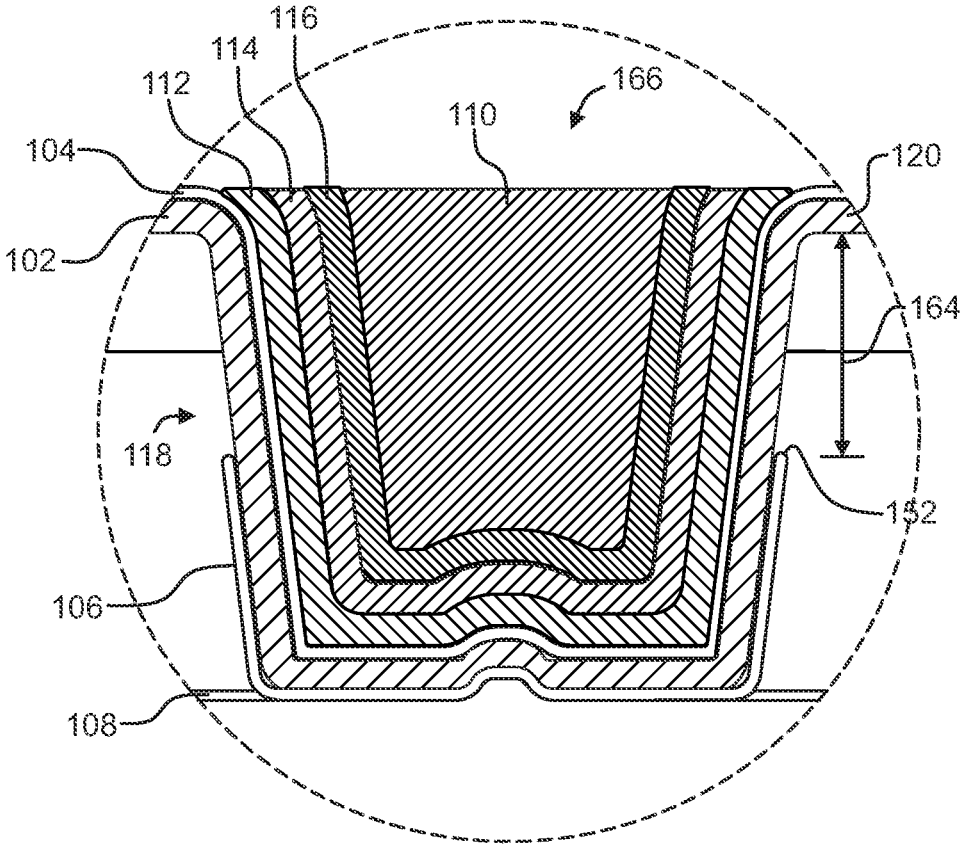
FIG. 17 is a magnified view of detail 17 in FIG. 16.
Figure 21:
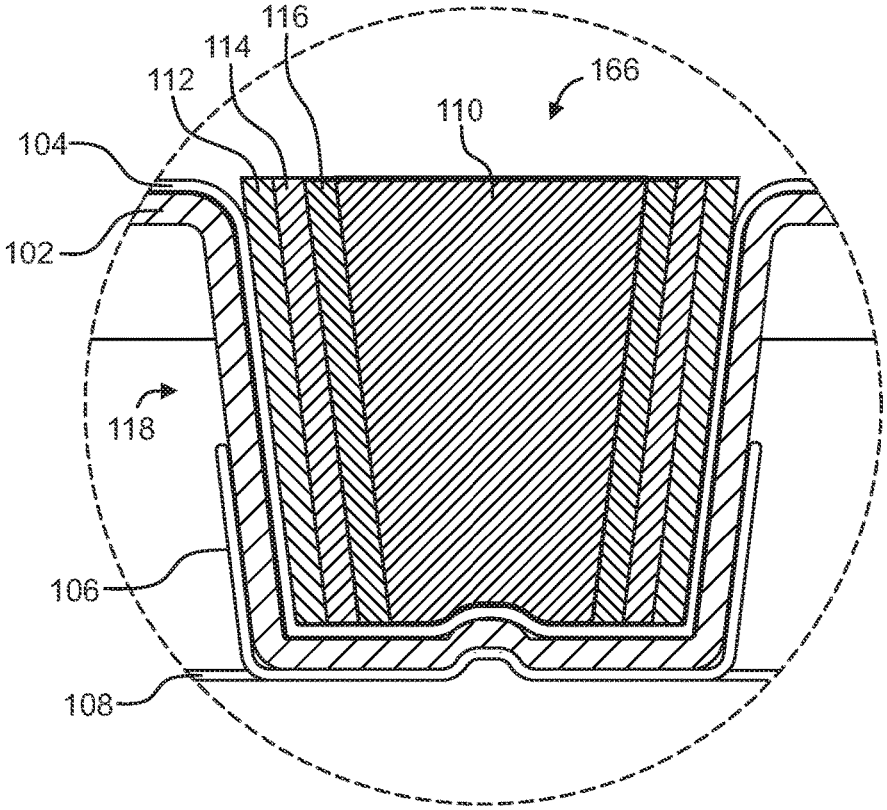
FIG. 21 is a magnified view of detail 21 in FIG. 20.
Figure 22:
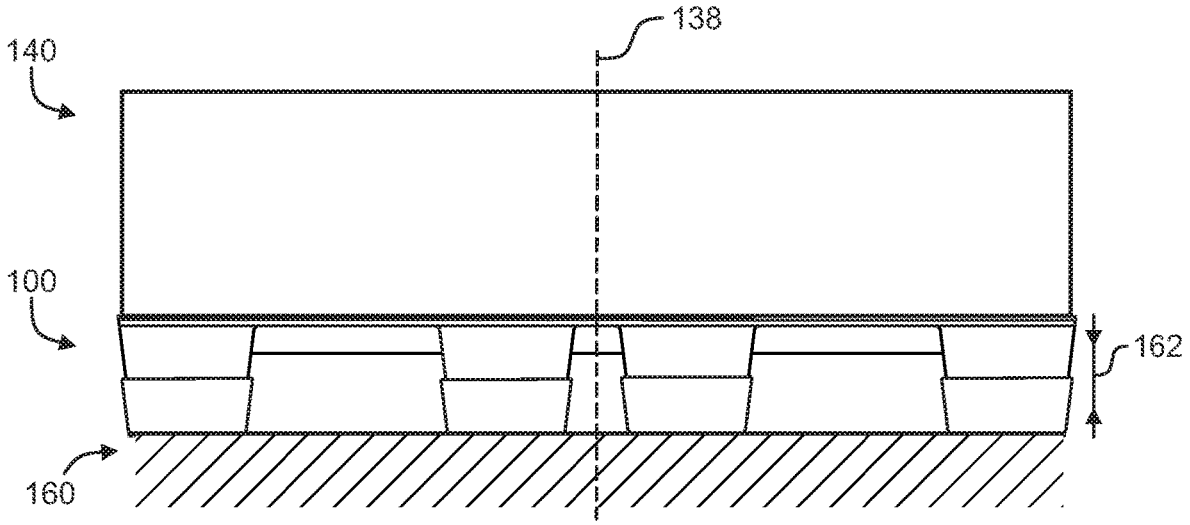
FIG. 22 is a side view of an example composite pallet in accordance with the present disclosure, wherein the pallet is shown supportingly disposed between a load and a substrate surface, thereby imposing a compression force on the pallet based on the weight of the load.
Figure 23:
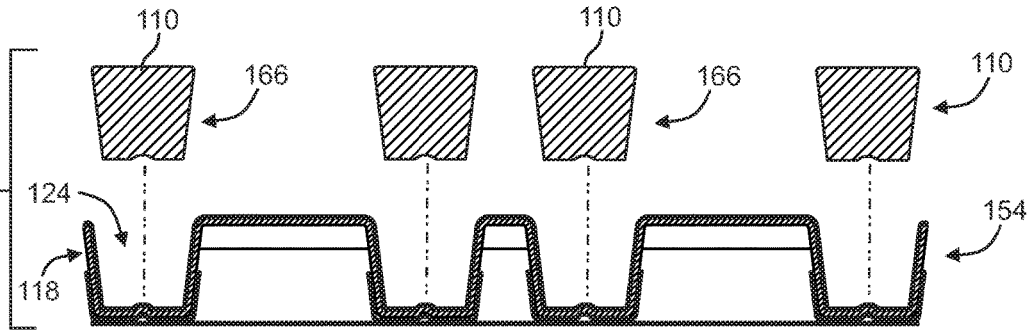
FIG. 23 is a diagrammatic cross-sectional view illustrating compression columns formed exclusively of compression column blocks being inserted into the pallet substructure similar to that of FIG. 11, thereby augmenting the compression strength of resulting composite pallet.
Figure 24:
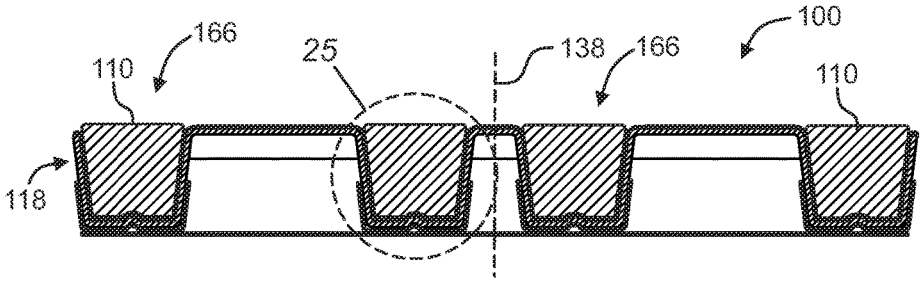
FIG. 24 is a diagrammatic cross-sectional view of an example composite pallet resulting from the assembly step illustrated in FIG. 23.
Figure 25:
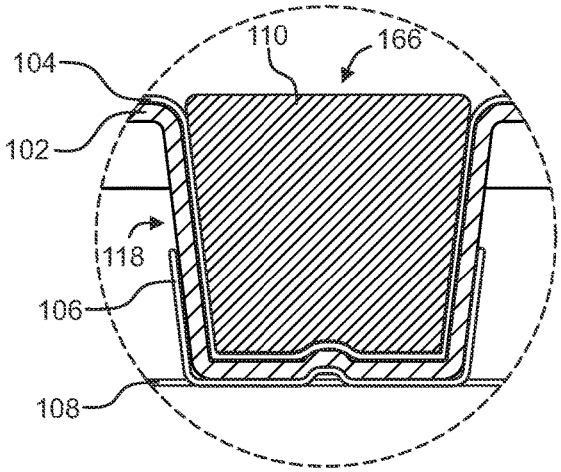
FIG. 25 is a magnified view of detail 25 in FIG. 24.

Referring to FIGS. 16, 20 and 24, certain preferred implementations of a composite pallet 100 may further comprise a multiplicity of compression columns 166. Each compression column may be disposed within the foot cavity 124 of a respective support foot 118. Referring to FIGS. 17, 21 and 25, each compression column 166 may include a compression column block 110. In particular implementations of a composite pallet 100 with compression columns 166, each compression column 116 may include a first column 112 layer disposed between the compression column block 110 and the respective foot cavity 124. Moreover, each compression column 166 may include a second column layer 114 disposed between the first column layer 112 and the compression column block 110. Furthermore, each compression column 166 may include a third column layer 116 disposed between the first column layer 112 and the compression column block 110.

Figure 18:
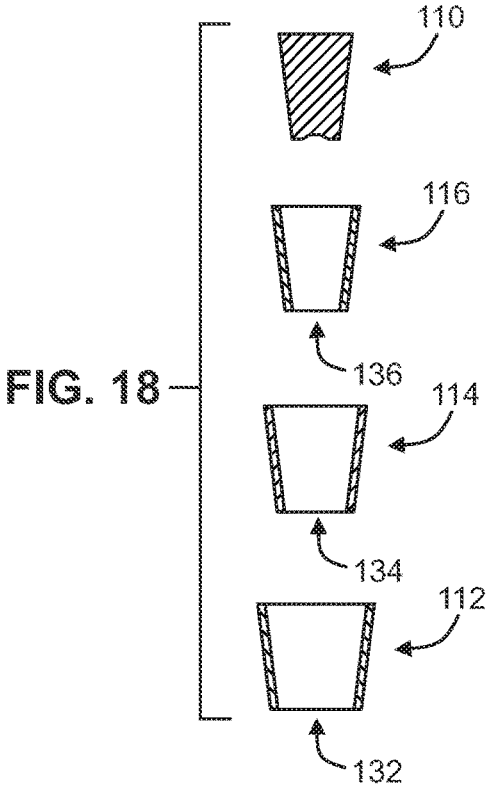
FIG. 18 is a diagrammatic exploded cross-sectional view of another non-limiting example of a compression column, wherein the compression column includes a compression column block and three sequentially nestable column layers having open bottoms.
Figure 19:
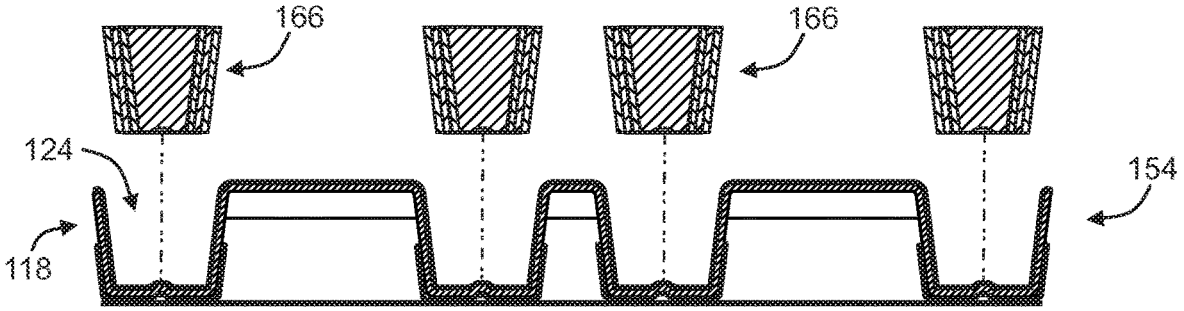
FIG. 19 is a diagrammatic cross-sectional view illustrating compression columns formed from the components shown in FIG. 18 being inserted into the pallet substructure similar to that of FIG. 11, thereby augmenting the compression strength of resulting composite pallet.

Referring to FIGS. 18 and 21, in certain implementations of a composite pallet 100 with compression columns 166, one or more of the column layers (112, 114, 116) may have open bottoms (132, 134, 136). This may be referred to as a nested-sleeve configuration for a compression column 166.

Figure 14:
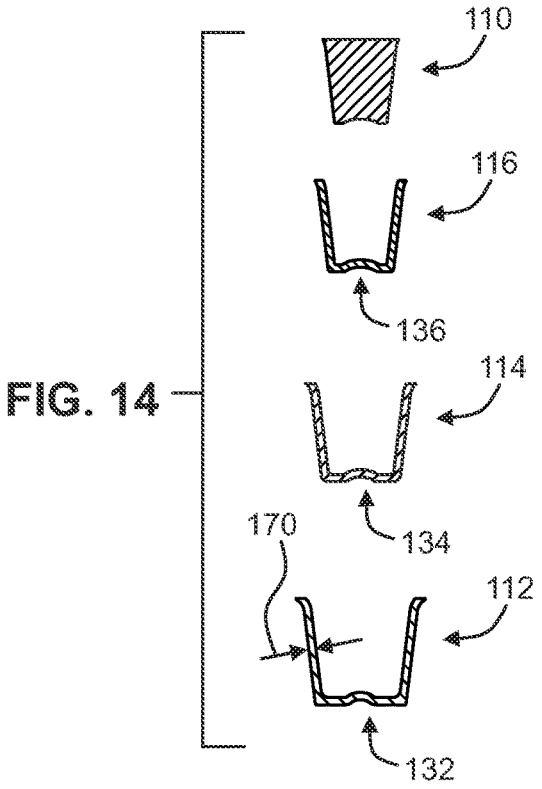
FIG. 14 is a diagrammatic exploded cross-sectional view of one non-limiting example of a compression column, wherein the compression column includes a compression column block and three sequentially nestable column layers having closed bottoms.
Figure 15:
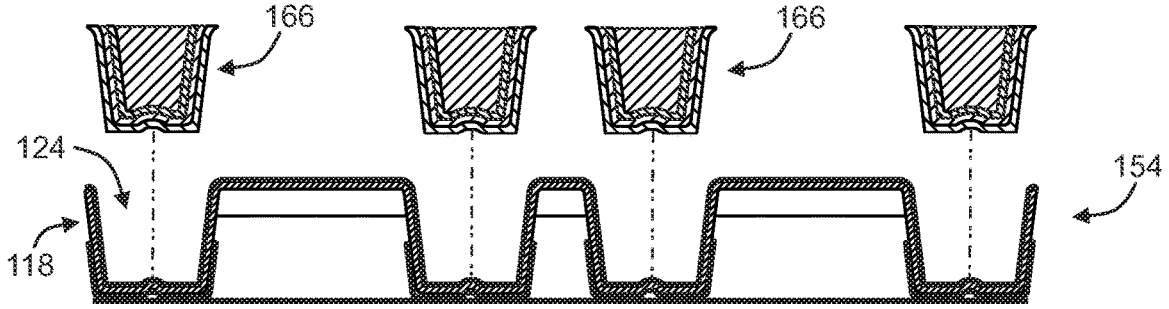
FIG. 15 is a diagrammatic cross-sectional view illustrating compression columns formed from the components shown in FIG. 14 being inserted into the pallet substructure similar to that of FIG. 11, thereby augmenting the compression strength of resulting composite pallet.

Referring to FIGS. 14 and 17, in certain implementations of a composite pallet 100 with compression columns 166, one or more of the column layers (112, 114, 116) may have closed bottoms (132, 134, 136). This may be referred to as a nested-cup configuration for a compression column 166.

In particular implementations of a composite pallet 100 with compression columns 166, the compression column blocks 110 and column layers (112, 114, 116) may be comprised of a material selected from the group consisting of plant fiber, synthetic fiber, metal, wood and plastic. Moreover, referring to FIG. 14, the column layers may preferably have a wall thicknesses 170 of, for example, 9-15 millimeters.

Certain additional details regarding a process for manufacturing the composite pallet 100 are provided below.

The pallet pulp body 102, such as that shown in FIGS. 1 and 2, may be fabricated on a pulp molding machine. The resulting thickness of the pallet pulp body 102 may preferably be, for example, 9-15 mm. The pallet pulp body may preferably comprise or consist of 9 or 12 pallet support feet 118. Grooves (otherwise referred to herein stiffener channels) may be connected with the supporting feet around the pallet pulp body 102, which can greatly strengthen the compressive and flexural strength of the resulting composite pallet.

The column layers (112, 114, 116) may also be made on a pulp molding machine, and then inserted into the foot cavities of the pallet pulp body 102. Their individual or collective wall thickness may be, for example, 9-15 mm. The single block type foot compression column 110 may be, for example, die-cast once in a block press.

Figure 3:
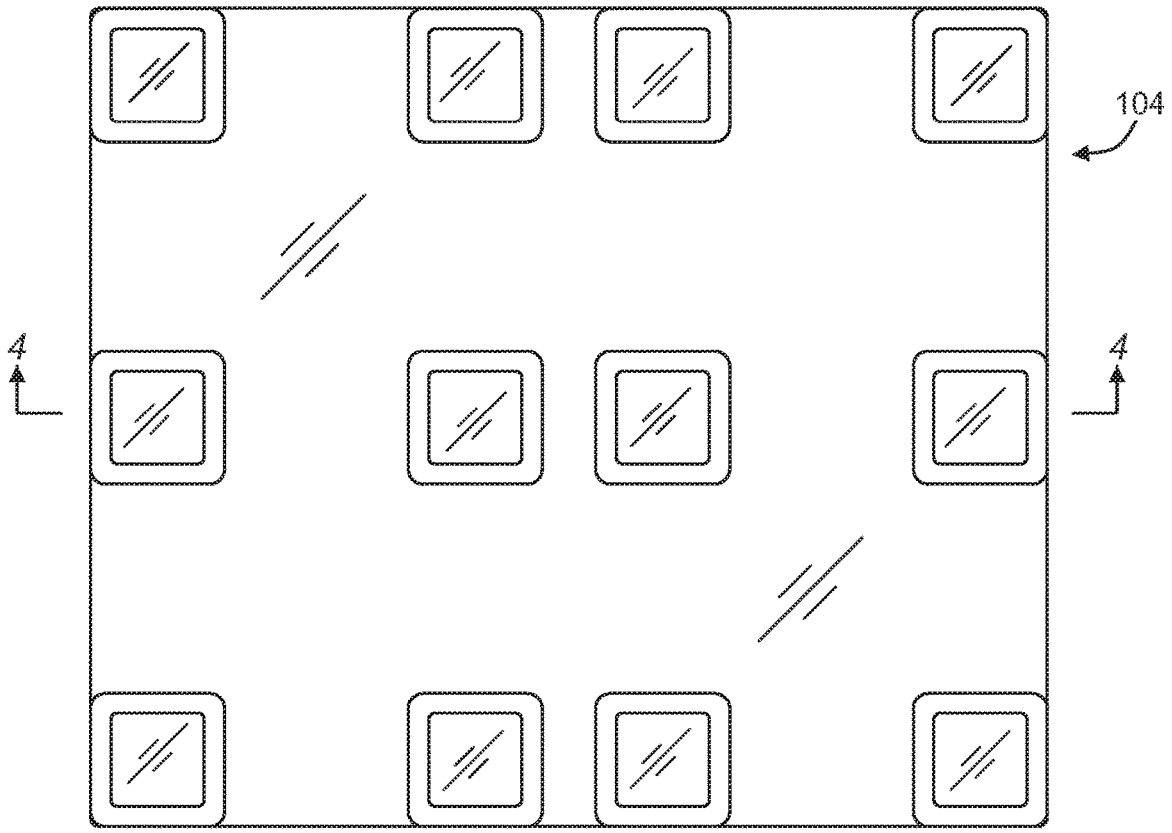
FIG. 3 is a diagrammatic top view of one non-limiting example of an upper film layer.
Figure 4:
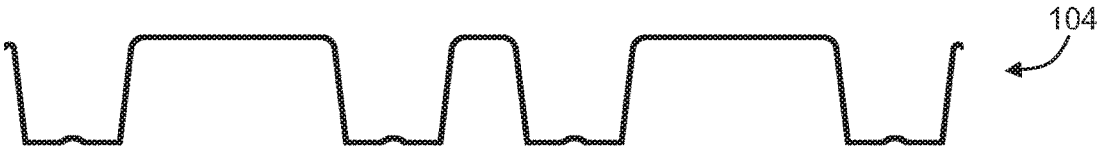
FIG. 4 is a diagrammatic cross-sectional view taken along lines 4-4 of FIG. 3.

The upper film layer 104 may be formed as shown in, for example, FIGS. 3 and 4. This upper film layer 104 may preferably be formed from recycled PE plastic, in an injection molding machine. The primary function of this upper film layer 104 is to provide waterproofing and to increase the surface strength of the pallet.

Regarding the production of the support foot sheath 106, these are preferably comprised of a plastic and may be formed as shown in FIGS. 5 and 6. These too may be made from raw material such as recycled PE plastic, and may be formed in an injection molding machine. The primary functions of these sheaths 106 are to provide waterproofing and to increase the rigidity of the pallet support feet. The average wall thickness of these support foot sheaths 106 may preferably be 1-5 mm.

Figure 7A:
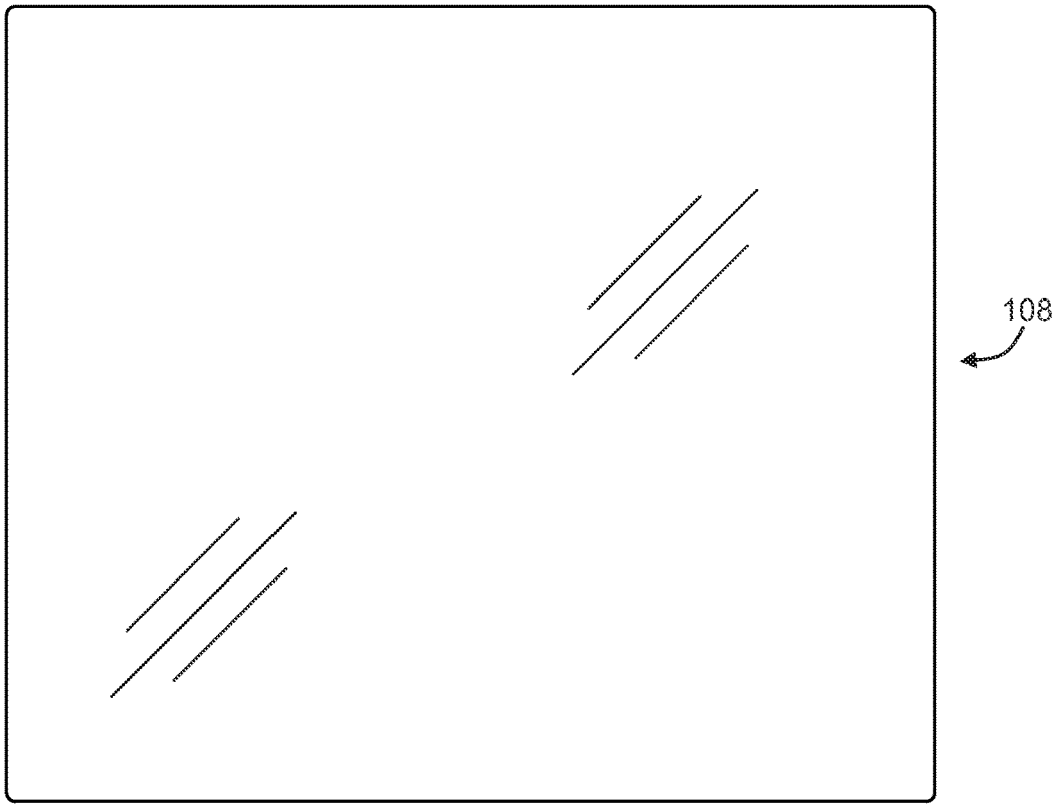
FIG. 7A is a diagrammatic top view of one non-limiting example of a support bottom plate in planar form.
Figure 7B:
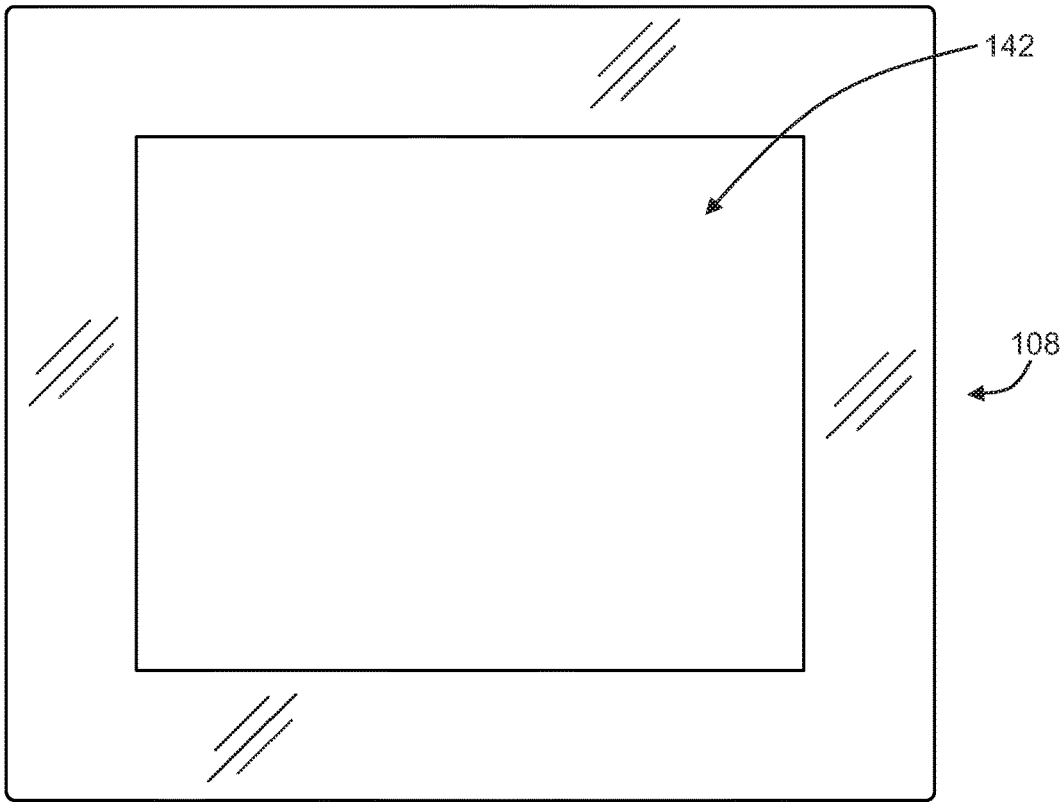
FIG. 7B is a diagrammatic top view of another non-limiting example of a support bottom plate in planar form but wherein the plate includes a bottom plate aperture.

Referring to FIGS. 7A and 7B, the support bottom plate 108 may be of, for example, two types. The first type, represented for example in FIG. 7A, may be a fully enclosed bottom plate. In contrast, the second type, represented in FIG. 7B, may be a semi-enclosed bottom plate with, for example, one or more bottom plate apertures 142. The first type of bottom plate 108 can be glued (other otherwise affixed) to all of the support foot sheaths 106 of the pallet, which in turn can raise the strength of the pallet to the highest strength, suitable for the static load of, for example, more than 1000 kg. The second type of bottom plate 108 may be glued, for example, to just the support foot sheaths 106 disposed at the periphery of the pallet. These support bottom plates 108 may preferably be made of a raw material mainly comprising recycled PE plastic, and can also be produced using a conventional injection molding machine.

Figure 9:
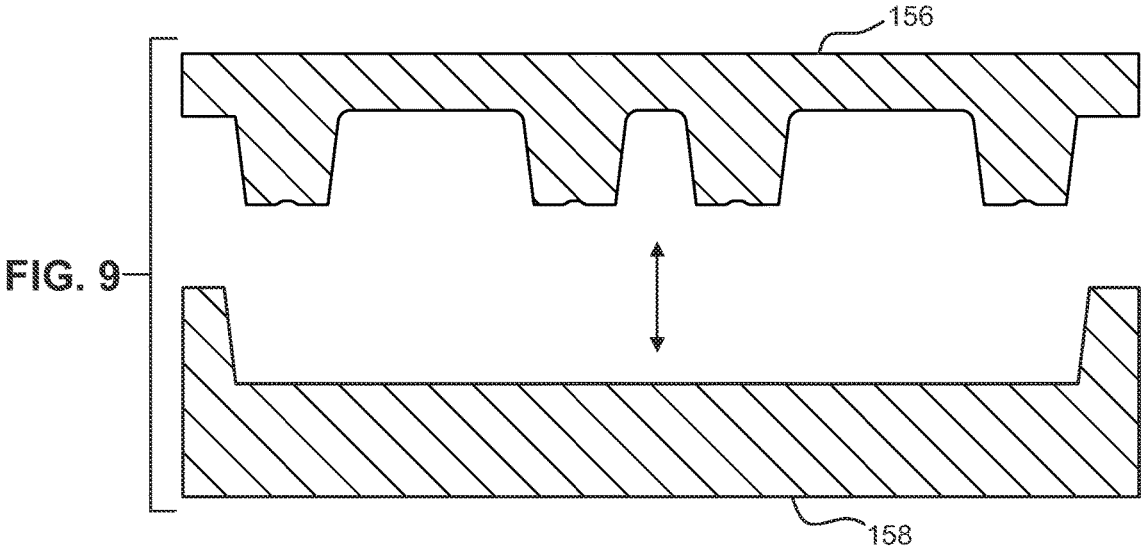
FIG. 9 is a diagrammatic cross-sectional view of a hot-press mold system with the upper and lower hot press molds shown separated from one another.
Figure 10:
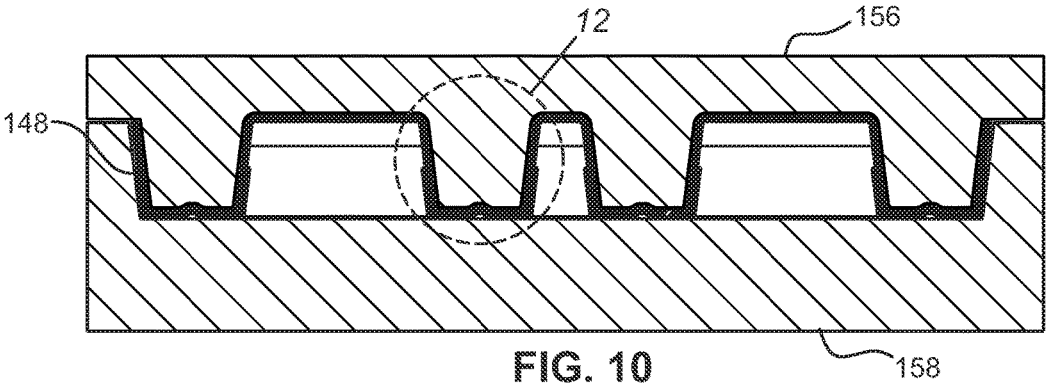
FIG. 10 is a diagrammatic cross-sectional view illustrating the composite pallet components of FIG. 8 being pressed and formed in the hot-press mold system of FIG. 9.

Referring to FIGS. 8-10, the bottom plate 108, support foot sheaths 106, the pulp body 102 and the upper film layer 104 can be placed into the lower mold 158 of a hot press machine. The upper mold 156 falls and closes with the lower mold 158. As shown in FIG. 10, the upper and lower molds are pressed together at, for example, 90° C. for several seconds. The molds are then pulled apart and the resulting pallet product is removed, as illustrated for example in FIG. 11.

After removing the pallet substructure 154 from the hot press mold, depending upon the desired compression resistance of the composite pallet 100, one of several different forms of foot compression columns 166 may be set in the foot cavities of the pallet support feet 118. For example, each compression column 166 in the composite pallet shown in FIGS. 16 and 17 may include three sets of column layers (112, 114, 116) with a compression column block 110, and may thereby enable the resulting composite pallet 100 to sustain a load weight of, for example, 6000 kg. The same pallet load rating may be achieved with the composite pallet configurations shown in FIGS. 24 and 25, wherein the compression columns 166 are only comprised of a single compression column block 110 without column layers added. A pallet load rating of, for example, 4000 kg may be achieved by employing compression columns 116 with three column layers (e.g., 112, 114, 116) and without any compression column block 110. A pallet load rating of, for example, 2000 kg may be achieved without employing any compression columns 116.

Applicant has conducted at least one load test of the composite pallet 100 configuration illustrated in FIG. 16, wherein the following components were comprised merely of paper pulp: pallet pulp body 102, support foot sheath 106, support bottom plate 108, compression column block 110, first column layer 112, second column layer 114 and third column layer 116. In this test, the composite pallet 100 was successfully subjected to a static load 140 of 6 metric tons (13227 pounds) for a period of 4.5 months. It is anticipated that using materials other than or in addition to paper pulp could increase the load bearing performance of the composite pallet 100 well beyond the 6 tons demonstrated during testing.

The following listing matches certain terminology used within this disclosure with corresponding reference numbers used in the non-limiting examples illustrated in the several figures.

100 composite pallet with augmented compression support
102 pallet pulp body
104 upper film layer (e.g., recycled PE plastic)
106 support foot sheath
108 support bottom plate
110 compression column block
112 first column layer (e.g., sleeve or cup configuration)
114 second column layer (e.g., sleeve or cup configuration)
116 third column layer (e.g., sleeve or cup configuration)
118 support foot
118' peripherally-disposed support foot
120 upper faceplate (of pallet pulp body)
122 pulp body wall thickness (e.g., 9-15 millimeters)
124 foot cavity (of support foot)
126 bottom of foot
**128*a*** straight stiffener channel
**128*b*** arcuate stiffener channel (e.g., multiple concentric)
130 pulp body periphery
132 bottom of first column layer
134 bottom of second column layer
136 bottom of third column layer
138 main axis (of pallet)
140 load (e.g., bearing it weight on pallet 100)
142 bottom plate aperture
144 channel depth
146 channel spacing
148 sheath cavity
150 sheath bottom
152 sheath periphery
154 pallet substructure (e.g., composite pallet without compression columns or column layers)
156 upper mold of hot press machine
158 lower mold of hot press machine
160 substrate surface (e.g., ground, floor, shelf)
162 compression direction
164 faceplate offset
166 compression column

168 sheath wall thickness (e.g., 1-5 millimeters)

170 column layer wall thickness (e.g., 9-15 millimeters)

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A composite pallet with augmented compression support, the pallet comprising:

a pallet pulp body being comprised of pulp and having an upper faceplate and a plurality of support feet disposed oppositely of the upper faceplate, a foot cavity being defined within each support foot;

a multiplicity of support foot sheaths, each support foot sheath enveloping at least a portion of a corresponding one of said support feet; and a support bottom plate affixed to two or more of the support foot sheaths;

wherein the support bottom plate (a) has a bottom plate aperture, and (b) is only affixed to support foot sheaths disposed peripherally about the pallet pulp body.

2. A composite pallet with augmented compression support, the pallet comprising:

a pallet pulp body being comprised of pulp and having an upper faceplate and a plurality of support feet disposed oppositely of the upper faceplate, a foot cavity being defined within each support foot;

a multiplicity of support foot sheaths, each support foot sheath enveloping at least a portion of a corresponding one of said support feet;

a support bottom plate affixed to two or more of the support foot sheaths; and a multiplicity of compression columns, each compression column being disposed within the foot cavity of a respective said support foot;

wherein each compression column includes a compression column block;

wherein each compression column includes a first column layer disposed between the compression column block and the respective foot cavity; and wherein each compression column includes a second column layer disposed between the first column layer and the compression column block.

3. The composite pallet of claim 2, wherein each compression column includes a third column layer disposed between the first column layer and the compression column block.

4. A composite pallet with augmented compression support, the pallet comprising:

a pallet pulp body being comprised of pulp and having an upper faceplate and a plurality of support feet disposed oppositely of the upper faceplate, a foot cavity being defined within each support foot;

a multiplicity of support foot sheaths, each support foot sheath enveloping at least a portion of a corresponding one of said support feet;

a support bottom plate affixed to two or more of the support foot sheaths; and a multiplicity of compression columns, each compression column being disposed within the foot cavity of a respective said support foot;

wherein each compression column includes (a) a first column layer disposed within the respective foot cavity, (b) second column layer disposed within the first column layer, and (c) a third column layer disposed within the second column layer.

5. The composite pallet of claim 4, wherein each column layer has an open bottom.

6. The composite pallet of claim 4, wherein each column layer has a closed bottom.

7. The composite pallet of claim 2, wherein each compression column block and column layer is comprised of a material selected from the group consisting of plant fiber, synthetic fiber, metal, wood and plastic.

* * * * *